United States Patent [19]

Mueller et al.

[11] 4,239,132

[45] Dec. 16, 1980

[54] APPARATUS FOR FACILITATING INFLOW THROUGH CLOSURE THREADS OF DISPENSER

[75] Inventors: John J. Mueller, Woodbury, Minn.; Glenn L. Beall, Gurnee, Ill.

[73] Assignee: Containaire, Inc., Cleveland, Ohio

[21] Appl. No.: 956,236

[22] Filed: Oct. 31, 1978

[51] Int. Cl.[3] ..... B65D 37/00

[52] U.S. Cl. ..... 222/212; 220/366; 215/11 B; 215/11 E; 222/207; 222/386.5; 222/482; 222/491

[58] Field of Search ..... 215/11 E, 11 R, 11 D, 215/311, 315; 220/366; 222/94, 129, 130, 147, 205, 207, 211-213, 386.5, 491-496, 499, 188, 481, 481.5, 482, 478, 488

[56] References Cited

U.S. PATENT DOCUMENTS

| | | | |
|---|---|---|---|
| 1,881,929 | 10/1932 | Potterget | 222/481 |
| 1,983,101 | 12/1934 | Scribner | 222/481 |
| 2,286,797 | 6/1942 | Duerme | 215/11 E |
| 2,767,871 | 10/1956 | Shapiro | 215/11 B |
| 3,193,154 | 7/1965 | Brass | 222/213 |
| 3,645,414 | 2/1972 | Barr | 215/11 E |
| 3,656,660 | 4/1972 | Mueller | 222/94 |
| 3,878,972 | 4/1975 | Por | 222/207 |
| 4,061,254 | 12/1977 | Nilson | 222/494 |

*Primary Examiner*—H. Grant Skaggs

*Attorney, Agent, or Firm*—Watts, Hoffmann, Fisher & Heinke Co.

[57] ABSTRACT

Dispensing apparatus for a flexible container, including a closure for the container and an expansible bladder associated with the closure and adapted to fit within the container to expand and displace the dispensed contents. The closure has two openings, one at which it is attached to the container and the other forming an outlet for dispensing. A conduit extends from the bladder into the closure and communicates to the exterior of the closure and container through one of the two openings. The outlet opening is constructed to allow the contents to flow only in a direction from the container during use and a check valve allows flow through the conduit only into the bladder.

17 Claims, 12 Drawing Figures

Fig. 7
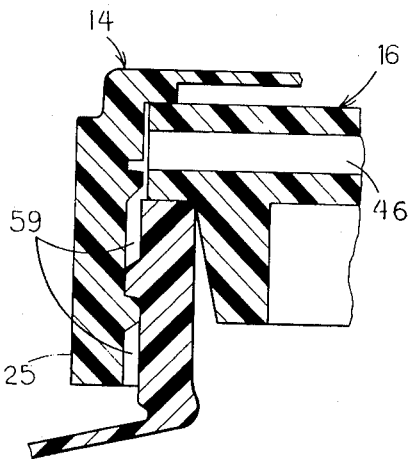
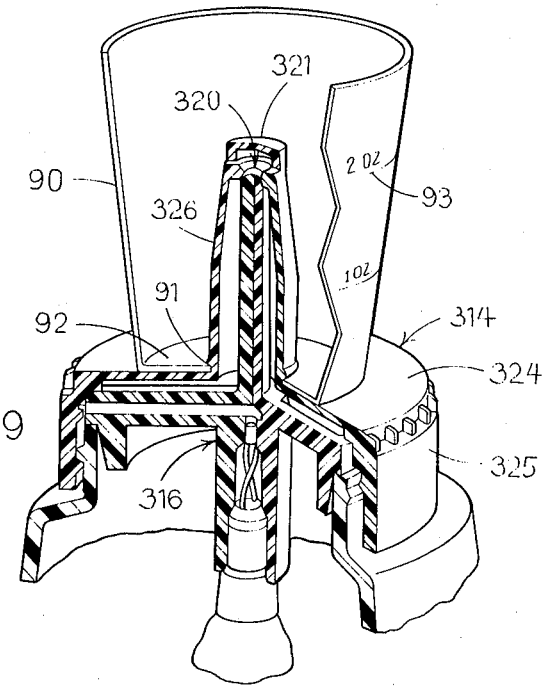
Fig. 9
Fig. 10
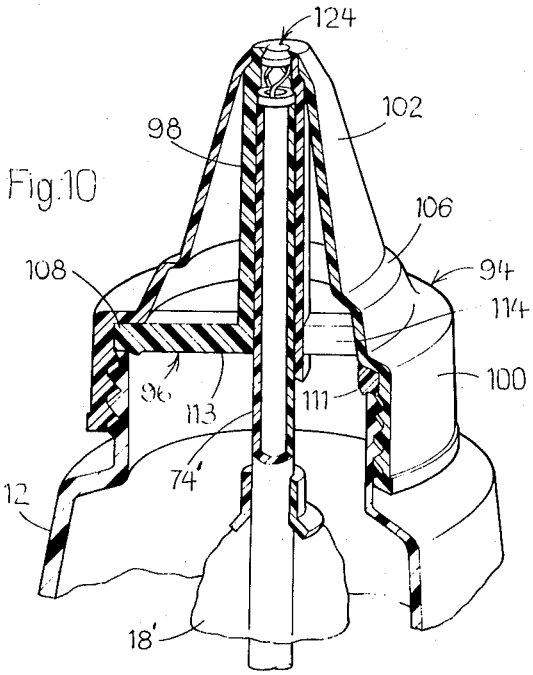
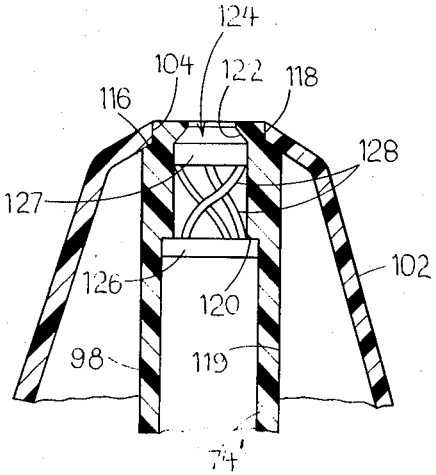
Fig. 11

APPARATUS FOR FACILITATING INFLOW THROUGH CLOSURE THREADS OF DISPENSER

BACKGROUND OF THE INVENTION

1. Field of the Invention

This invention relates to dispensers and more specifically to structure that converts a flexible, resilient, container into a squeeze-type dispenser in which a flexible bladder within the container receives ambient displacement fluid when contents of the container is dispensed.

2. Prior Art

This invention is an improvement over the devices disclosed and claimed in U.S. Pat. Nos. 3,319,837 issued May 16, 1967 entitled "Dispensing Device" and 3,656,660 issued Apr. 18, 1972 entitled "Closure Member and Dispensing Device." The structures disclosed in those patents utilize a bladder within a flexible, resilient, container to receive and contain displacement fluid such as air that flows into the container after contents has been dispensed by squeezing. Valves associated with the dispensing outlet and air inlet, operable in response to pressure differentials, assure that displacement fluid only enters the bladder, which then maintains the remaining contents at the dispensing outlet, in effect maintaining the container always "full" until empty. The disclosed structures have the disadvantage of requiring a separate inlet to the container to facilitate keeping the displacement fluid separate from the contents. As a result, special containers must be made or closures are required that have an extra inlet and different appearance from caps or dispensers lacking the advantageous features of the patented devices. The use of a special container is particularly disadvantageous and was avoided by the closure member disclosed in said patent 3,656,660. However, the closure member disclosed included substantial structural modifications and additional apparatus, including a housing for a collapsed bladder, a separate aperture communicating to the bladder, and flexible fingers to constrain the bladder during expansion. This structure has not proved as practical from a production and marketing standpoint as desired. In addition, the dispensing valve structure in the disclosed dispensers interfered with the flow of the dispensed contents, which did not flow in a well defined stream. While that disadvantage can be overcome by recessing the valve from the outlet opening, dispensed material may accumulate in the outlet beyond the valve and harden into a plug and/or become unsanitary, depending upon the nature of the material.

SUMMARY OF THE INVENTION

The present invention is exemplified by structure that supports a flexible displacement bladder for a flexible resilient container centrally of a dispensing closure member and that provides a valved inlet passageway to the bladder through one of the two inherent openings of the closure member; i.e., through the opening at which the closure member is attached to the container, or through the dispensing opening. The bladder is constructed to expand within the container from an inflow of displacement fluid to maintain the contents adjacent the dispensing opening.

The dispensing opening of the closure member is constructed to permit only outflow of contents from the container, for example, by incorporating a one-way valve or by being capable of retaining a portion of a viscous contents as a plug. Conduit-forming structure provides an inlet passageway that communicates between the bladder and the outside of the closure member through either the juncture between the closure member and container, or through a separate conduit associated with the discharge opening. A one-way or so-called check valve associated with the conduit-forming inlet structure permits inflow to and prevents outflow from the bladder.

Advantageously, the conduit-forming inlet structure is incorporated into a separate intermediate structure secured between the container and the closure. For this purpose the intermediate structure preferably has an annular washer-like, portion located between the opening of the container and the closure member to seal the juncture between the two and to secure the member firmly in place. A passage through the intermediate structure is isolated from the contents of the container, by-passes either the sealed juncture or the seal at the dispensing opening, and communicates between the exterior of the closure and the bladder.

In a preferred embodiment, where the closure is in the form of a threaded cap secured to the container by screw threads, a clearance between the closure and container along the threads provides a path from the exterior side to the interior side of the intermediate structure and the seal formed thereby. Displacement air can then enter the interior of the container through the passage. A conduit forming part of the intermediate structure extends the passage to a location centrally of the closure and connects to the interior of the bladder. The check valve that prevents outflow from the bladder is located in the conduit portion of the intermediate structure.

In an alternative embodiment, flow of displacement fluid into the bladder is through intermediate structure that communicates through the discharge outlet of the closure member. The intermediate structures may advantageously form a part of the discharge valve structure. A passage formed in the intermediate structure, opening at an outer end beyond the discharge check valve seal and at an inner end into the bladder, serves to by-pass the discharge valve seal and provide a flow path isolated from the contents of the container.

In a preferred construction of the closure, the intermediate structure in part forms a stationary post relative to which a portion of the closure member moves. The movable portion includes the dispensing opening and provides a fluid-tight seal with the post at one extreme of its movement to prevent entry of displacement fluid directly into the container, without interfering with flow into the bladder within the container through the inlet passage. At the other extreme of its movement its provides an opening through which the contents of the container can be dispensed. Movement is permitted by a flexible portion of the closure member. The closure shapes the stream at the dispensing opening by defining a passage beyond the post, and any material remaining in the passage is cleared by the post as the closure returns to its sealing position. The opening can be shaped as desired, e.g., it can be circular or elongated transversely of the flow to form a viscous contents into a ribbon form.

One variation contemplated is an intermediate member of a cap-like structure that in part forms a discharge passage and that is secured directly to a container, as by a threaded portion. The cap-like structure includes an integral center post and a longitudinal passage through the post to the bladder by which the bladder communicates to the exterior of the container. A closure that also in part forms the discharge opening is supported on the cap-like structure surrounding the post, and is movable longitudinally thereof. The cap-like structure forms a movable spout about the post. A seat portion of the closure forms a seal with the post in one position of the closure and provides an opening about the post for the discharge of the container contents through the spout in a second position longitudinally displaced from the first. The closure is yieldably biased to the first position and moves to the second in response to an increase in the internal pressure of the container, as when it is squeezed. Displacement fluid enters the bladder via the passage that opens through the outer end of the post and is controlled by a one way valve located at some point along the passage to the bladder.

Advantageously, a tube is provided in the bladder, communicating with the inlet passage through the cap. The tube is constructed to control the air entry point within the bladder, to facilitate insertion of the bladder into the container, and to promote orderly expansion of the bladder by restraining it longitudinally within the container.

With the above arrangements, material directly within the interior of the flexible resilient container is dispensed when the container is squeezed, and upon subsequent expansion of the container to its original volume, displacement fluid, such as air, flows only into the bladder within the container. As a result, the container, closure member and bladder form a dispenser of the constant volume type, which is divided into two separate zones, one for the material being dispensed and one for air or other fluid to displace the dispensed material. The respective volumes of the two zones vary inversely as the outer container, originally full of material to be dispensed, is emptied through use.

Other embodiments of closure structure and intermediate members are contemplated to provide particular features and structural variants of the basic elements. The specific embodiments referred to as well as possible variations and the various features and advantages of this invention will become better understood from the detailed description that follows, when considered in connection with the accompanying drawings.

BRIEF DESCRIPTION OF THE DRAWINGS

FIG. 7 is a detailed sectional view illustrating a portion of the inlet path for displacement fluid through the closure of the container of FIG. 1;

FIG. 9 is a partial perspective view, in part cut away, illustrating a further embodiment of the invention;

FIG. 10 is a partial perspective view, in part cut away, illustrating a further embodiment of the invention;

FIG. 11 is a partial detailed view of the structure of FIG. 10; and

DETAILED DESCRIPTION OF PREFERRED EMBODIMENTS

Figure 1:
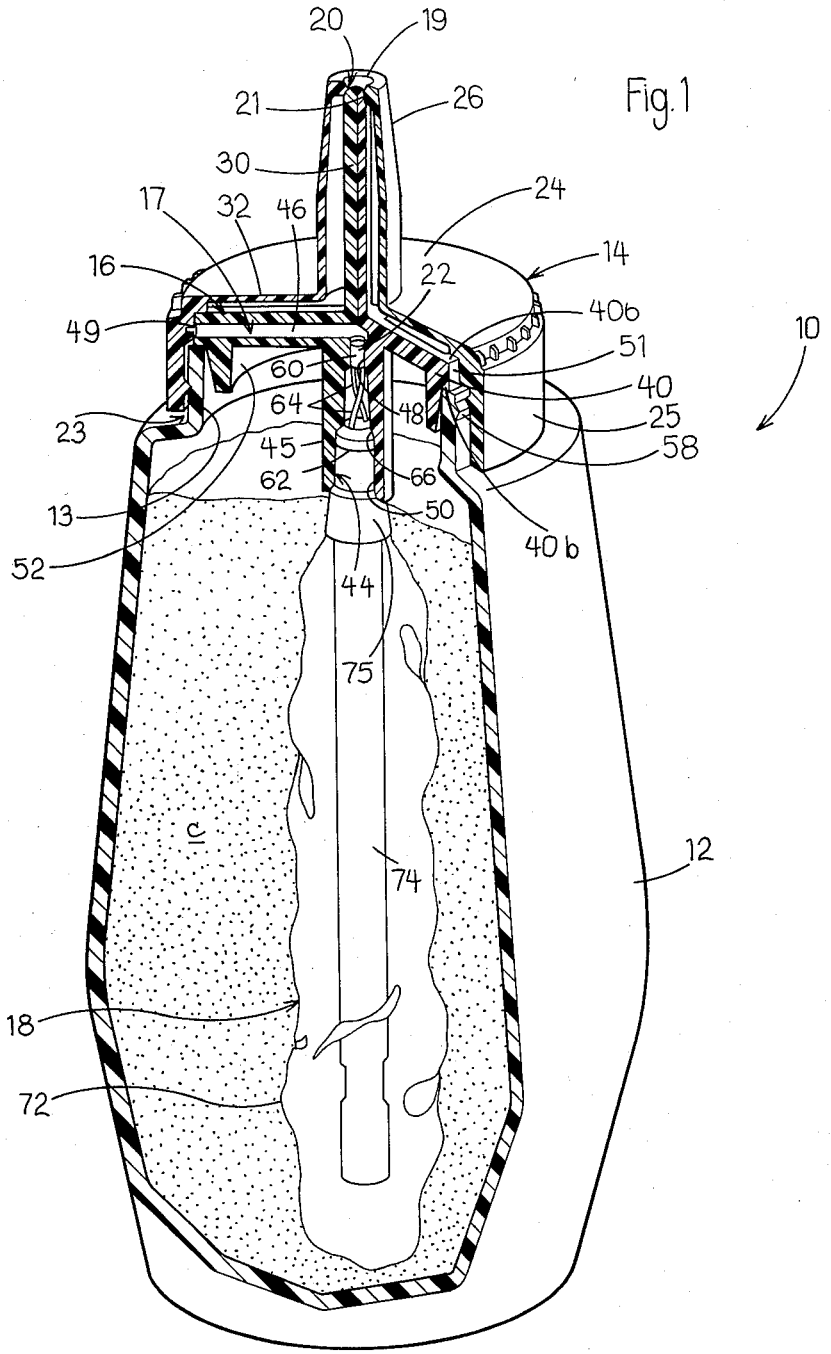
FIG. 1 is a perspective view with parts cut away illustrating structural details of a container incorporating the present invention, the container being illustrated in the substantially filled condition.
Figure 2:
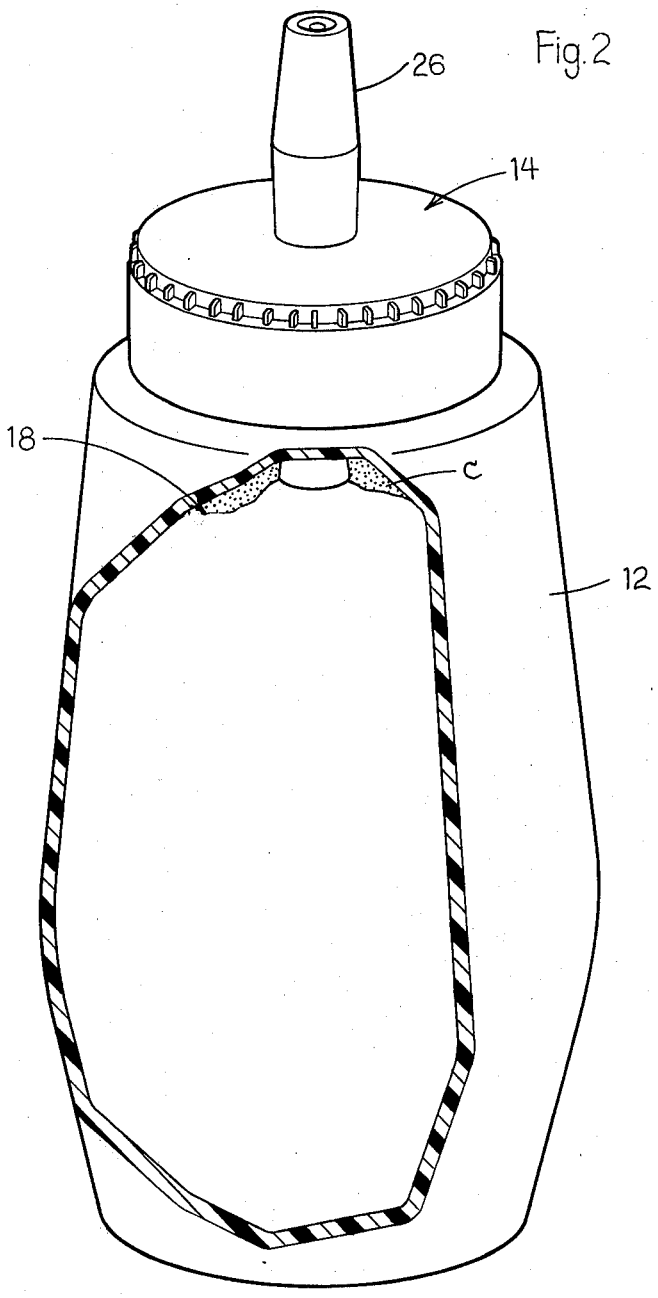
FIG. 2 is a perspective view with parts cut away of the container of FIG. 1, illustrating a substantially empty condition.

With reference to the drawings, a dispenser 10 is shown in FIG. 1, which includes a flexible, resilient container, such as a plastic bottle 12, having an opening 13; a closure member 14; an intermediate member 16 between the closure member 14 and container 12; and a flexible, expansible bladder 18 secured to and depending from the intermediate member 16 and extending downwardly into the container 12. The closure member 14 includes a dispensing outlet 19, which together with the intermediate member 16, forms a one-way discharge valve 20. The intermediate member 16 includes a one-way inlet valve 22 to the bladder 18 within a conduit 17 for bringing displacement air from outside the dispenser 10 to the bladder within the container, through an open end 23 of the closure member 14 that receives the open end of the container 12. The dispenser 10 shown in FIG. 1 is filled with flowable contents C to be dispensed and the bladder 18 is essentially empty. In FIG. 2, the dispenser is shown in a substantially empty condition, in which the bladder 18 is filled with displacing fluid, such as air, which has maintained the remaining contents C adjacent the dispensing outlet 19 of the closure member.

The closure member 14 includes a cap portion 24 with a threaded skirt 25 and a spout portion 26 that terminates in the dispensing outlet 19 for discharging flowable contents from the dispenser. The one-way discharge valve 20 includes a seat 21 that forms a seal in the spout portion 26 at the discharge orifice 19. The valve 20 is constructed to allow flow from the dispenser in response to increased internal pressure, but to prevent inward flow of displacement fluid when the pressure within the dispenser is decreased. The outer surface of the spout portion 26 can frictionally retain a shipping cap (not shown), which prevents inadvertent discharge of the contents.

The one-way valve 20 in the preferred embodiment results from the cooperation of the spout structure 26 and seat 21 with a post portion 30 of the intermediate member 16. To this end, the closure member includes a thin, resilient, diaphragm-like, annular portion 32 between the threaded skirt 25 and the spout portion 26 that will deflect to move the spout and seat longitudinally of the post 30. Also, the spout wall is relatively thin adjacent the juncture with the diaphragm portion, providing flexibility that facilitates the movement of the spout. In the closed condition shown in FIGS. 1 and 4, the seat 21 is held against the end of the post under tension created by the relative lengths of the post and spout and the resilience of the annular diaphragm portion 32. Thus, with equal external and internal pressure, the seat provides an effective seal. Increased internal pressure within the dispenser will deflect the diaphragm to move the spout and seat longitudinally away from the end of the spout to allow outward flow of the contents. After dispensing, the resilience of the portion 32 returns the seat to its sealing relationship slightly before equalization of pressure on opposite sides of the closure is reached. With the closure member 14 molded of plastic, preferably low density polyethylene, the portion 32 is inherently flexible and resilient.

Figure 6:
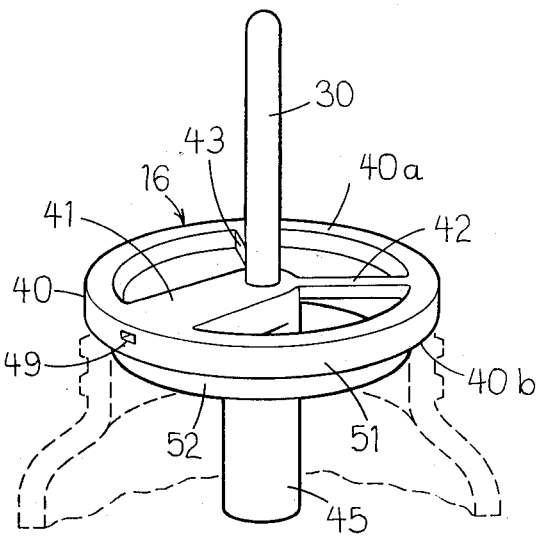
FIG. 6 is a perspective view of an intermediate member located between the container and closure of FIG. 1 for providing a path for displacement fluid.

The intermediate member 16, in addition to partially forming the discharge valve 20, serves as a seal between the closure member and container and also as a conduit communicating between the bladder 18 and the outside of the dispenser 10. The member 16 has a circular support portion 40 of a diameter comparable to that of the opening 13 of the container. The portion 40 supports the post 30 and provides a seal between the opening 13 and the cap portion 24 of the closure member. The post is supported centrally of the circular portion 40 by three radial spokes 41, 42, 43 (FIG. 6) and extends perpendicularly from the plane of the circular portion and spokes into the spout portion 26. A cavity 44 is formed in a central hub 45 that is also supported by the spokes 41, 42, 43 and extends in the opposite direction from the post, i.e., toward the interior of the container 12. The cavity 44 receives and supports the valve 22 and one end of the bladder 18. A passage 46 forming a part of the conduit 17 extends from the cavity 44 through the radial spoke portion 41 and terminates in an orifice 49 at the outer peripheral surface 51 of the circular portion 40. An internal tapered surface 48 of the cavity 44 functions as a valve seat for the one-way inlet valve 22 and a circumferentially ribbed internal surface 50 receives and supports a tubular portion of the bladder structure.

The circular portion 40 of the intermediate member has a smooth upper surface **40*a* that faces the cap portion 24 and a smooth lower surface 40*b* that rests against the end of the container at the opening 13. For sealing purposes, a resilient surface can be provided on the surfaces 40*a*, 40*b* or on the cap or container portions against which they abut, if desired. A circular flange 52 depends from the lower surface 40*b*, of a diameter smaller than that of the peripheral surface 51, sized to fit securely (i.e., a friction fit) within the opening 13 of the container to centrally locate and retain the intermediate member 16**. This facilitates subsequent application of the cap and is particularly advantageous if the intermediate member and bladder are inserted prior to filling the container with its contents because the parts will remain in the desired relationship during transporting, filling and capping.

Figure 5:
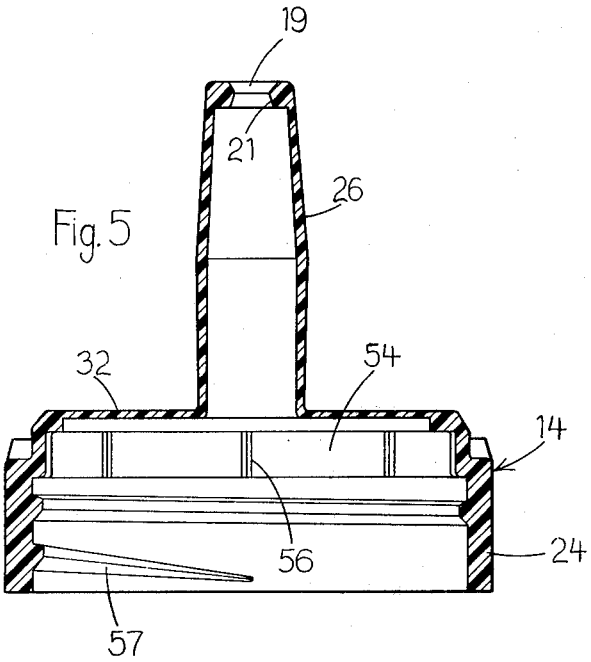
FIG. 5 is a detailed sectional view of the container closure of FIG. 1.

The outer peripheral surface 51 is encircled by an internal cylindrical wall 54 (FIG. 5) of the cap portion. The wall 54 is uniformly spaced from the surface 51 by circumferentially spaced projections 56 that contact the surface 51. By virtue of this arrangement, a flow path is assured from the threaded skirt to the orifice 49 and passage 46 in the intermediate member 16.

When threads 57 of the skirt 25 of the closure member engage external threads 58 of the container 12 and the closure is tightened, a seal is created along the surfaces **40*a*, 40*b* of the circular portion 40 of the intermediate member, isolating the interior of the container from the threaded opening of the closure member. However, the passage 46 through the intermediate member 16 bypasses the seal to communicate between the bladder 18 within the container and the atmosphere outside the container, through a clearance gap 59 (See FIG. 7) along the respective threads of the closure member and container. The clearance gap 59 provides a helical path from the lower portion of the threaded skirt 25 to the outer surface 51 of the circular portion 40, where it communicates with the orifice 49 and passage 46 to the cavity 44 and bladder 18, through the one-way inlet valve 22**.

The valve 22 includes a tapered valve head 80, a supporting ring 62 and helical spring strips 64 between the two, yieldably urging the valve head 60 against the internal seating surface 48 of the cavity 44. In the preferred embodiment, the valve is a one-piece plastic injection molded part. The supporting ring 62 is located against a shoulder 66 in the cavity, the distance between the shoulder and the seating surface 58 being such that the spring strips yieldably urge the valve head 60 into seating relationship under sufficient force to maintain an adequate seal to prevent fluid passage in a direction outwardly from the cavity through the passage 46 while allowing in-flow in response to the tendency of the container to return to its original configuration after being squeezed.

In the preferred form, the bladder 18 is comprised of a flexible pouch in the form of a thin-walled plastic bag 72. Advantageously, it is blow-molded of a size and shape so that when expanded it substantially fills the volume of the contained beneath the closure member 14. The bag 72 is supported by a plastic tube 74 to which it is secured by a thickened portion 75 that surrounds the tube in a sealed relationship. The tube 74 is open at both ends and facilitates flow into the bag at the bottom. The portion of the tube within the plastic bag 72 may have perforations along its length to facilitate flow into the bag along its length, if desired. Preferably, the length of the tube within the bag is approximately equal to the length of the bag to facilitate insertion of the flexible uninflated bag into a filled or empty container 12, and to maintain the bag extended into the container and away from the closure member to assure that the spout portion and discharge orifice are not blocked or isolated from the contents of the container. A bladder of this construction is available from Glasrock Products, Inc., Fairburn, Georgia.

The outer end of the plastic tube 74 that extends from the bag portion is received in the ribbed cavity portion 50 of the hub 45 with a tight friction fit or in addition may be positively secured, as by sonic welding. The end of the tube received in the cavity is directly adjacent and retains the one-way inlet valve 22. The valve 22, being normally closed, will prevent air or other fluid within the bladder from escaping when the container 12 is at rest or squeezed. By virtue of the construction of the valve, increased pressure within the bladder acts along with the force exerted by the spring strips 64 to maintain the valve closed. A reduction in pressure within the bladder 18 sufficient to create a differential adequate to overcome the biasing force of the spring strips 64 will open the valve to permit flow into the bladder, as when the resilient container expands after part of the contents has been dispensed.

Figure 3:
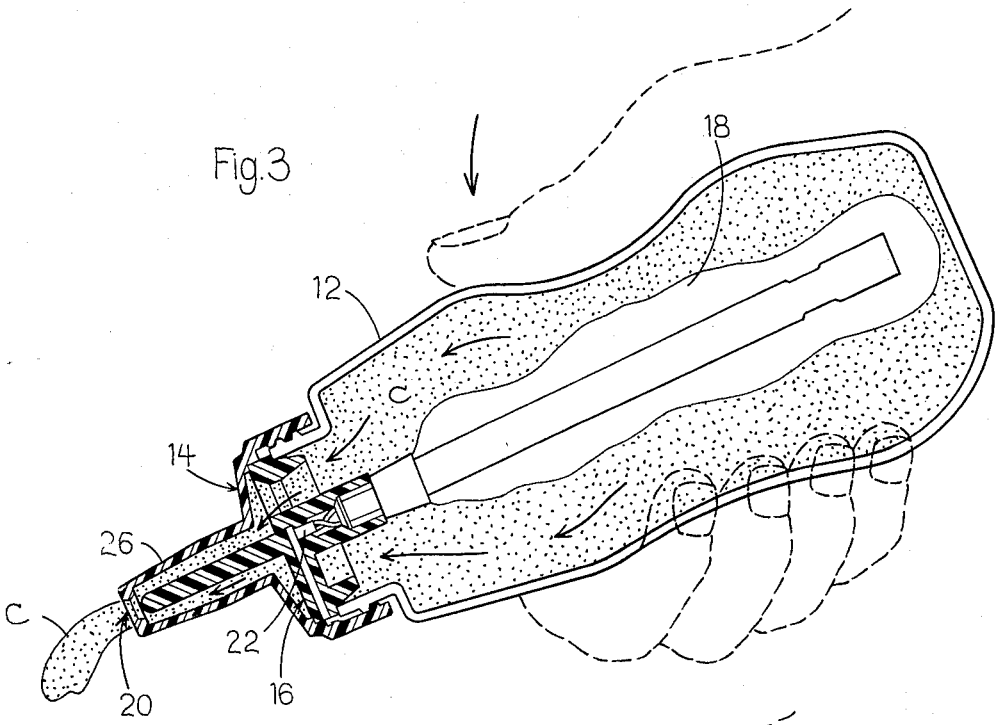
FIG. 3 is a diagrammatic longitudinal sectional view of the container of FIG. 1 illustrating the manner in which the material is dispensed.
Figure 4:
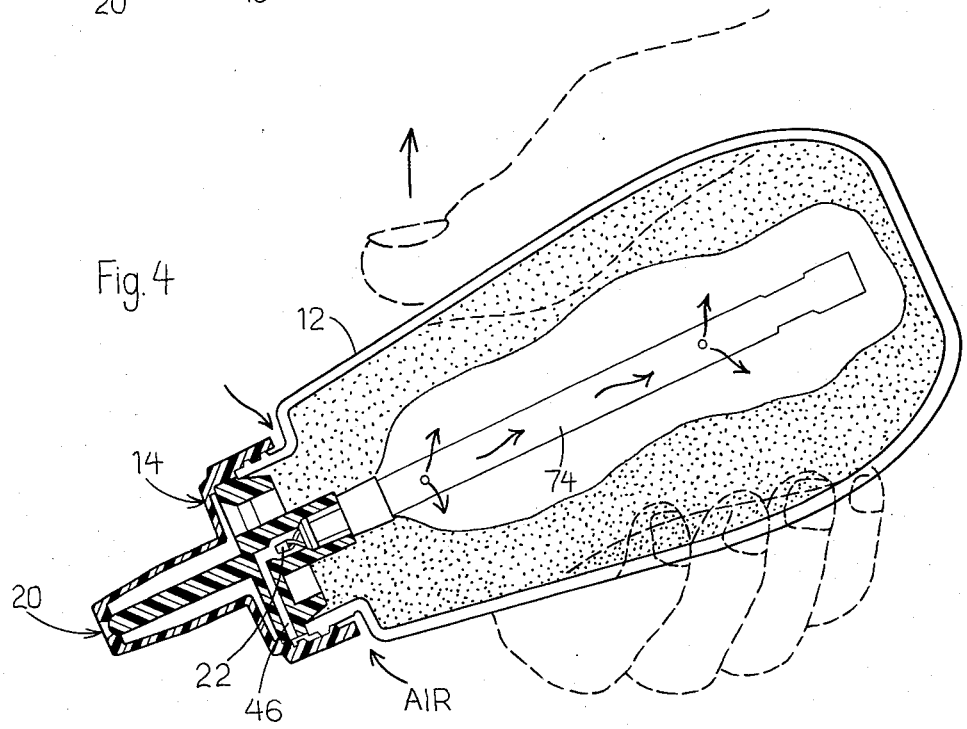
FIG. 4 is a diagrammatic longitudinal sectional view similar to FIG. 3, illustrating the manner in which dispensed material is displaced within the container.

The manner in which the dispenser 10 operates is illustrated in FIGS. 3 and 4. When the closure member 14 and the intermediate member 16 with the collapsed bladder 18 are assembled to the container 12, which is filled with flowable contents C, a seal is created about the opening 13 that prevents exit of the contents except through the discharge valve 20. Thus, when the flexible, resilient, container 12 is squeezed as illustrated in FIG. 3, to deflect the container wall inwardly, increased internal pressure forces the contents through the discharge valve 20, which opens when the increased internal pressure overcomes the spring force of the valve biasing it closed, allowing the material to flow through the spout portion 26. The flow of material passes about the post 30 and flows as a uniform stream from the spout. Air or other displacement fluid within the bladder 18 is prevented from escaping through the tube 74 under the increased internal pressure within the container by the one-way inlet valve 22. Thus, the volume of the bladder remains constant during the discharge of contents.

Upon release of the force on the flexible container that reduced the internal volume, the inherent resiliency of the container wall restores the container to its original volume, as illustrated in FIG. 4. A reduction in internal pressure results, causing the one-way discharge valve 20 to close. This restricts the flow of displacement fluid (typically air) into the dispenser to the helical path formed by the clearance between the threads of the closure member and container and then to the passage 46 in the intermediate member 16. The differential in pressure between the outside atmosphere and the volume within the container, including the volume within the bladder 18, overcomes the spring pressure of the one-way inlet valve 22, allowing displacement fluid, such as air, to flow through the passage 46 and the plastic tube 74 into the bag 72. This expands the bag 72 to displace the contents dispensed. It will be appreciated that the bag isolates the displacement fluid from the contents, and the physical configuration of the bag and its location within the container limit the location of the displacement fluid. The location of the displacement fluid and bag at maximum volume is indicated in FIG. 2, illustrating that the remaining contents to be dispensed is at all times maintained at locations that include the volume within and adjacent to the spout portion 26.

Where it is desired to facilitate refilling and re-use of the dispenser after it has been emptied, it is convenient to allow manual opening of the inlet valve 22 for deflation and removal of the bladder from the container. For that purpose, the top of the valve head 60 can be of slightly modified construction to extend into the transverse passage 46. Thus, by removing the closure member, access is available to the passage 46 and insertion of a wire or the like will unseat the modified valve head, allowing deflation of the bladder for removal and re-use. Alternatively, where the bladder tube is not permanently adhered to the intermediate member, separation of the two will allow deflation.

Figure 8:
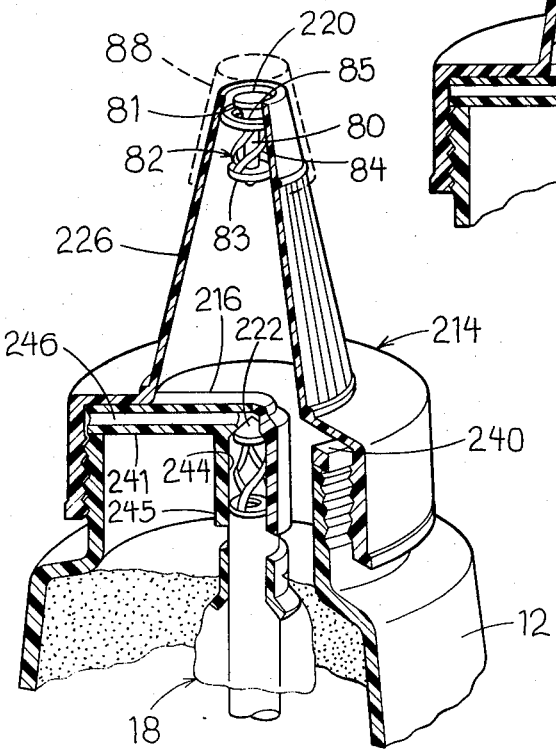
FIG. 8 is a partial perspective view, in part cut away, illustrating a further embodiment of the invention.

A modification of the closure member 14 is shown at 214 in FIG. 8. The closure member 214 in non-flexible and has a one-way discharge valve 220 that is independent of an intermediate member 216, which provides a circular supporting and sealing portion 240, a spoke 241 with a passage 246 and a central hub 245 with a cavity 244 to receive and support a one-way inlet valve 222 and the bladder 18. The construction of the particular valve 220 disclosed provides rotary as well as axial movement to assure a good seal. The valve 220 includes a stem portion 80, a tapered valve head 81 integral with the stem, and a spring portion 82. The spring portion 82 includes an end cup 83, three helical spring strips 84, and a ring 85. The end cup, spring strips and ring are integral, with the spring strips extending between the end cup and ring, about the stem portion 80. The ring encircles the stem and is held with a snap fit in an internal groove within the spout portion 226. In the embodiment shown, the stem is a separate piece from the spring portion 82 and is pressed into a central opening in the end cup 83 during assembly. The parts of the one-way valve 220 are of a size that the spring portion 82 biases the valve head 81 into a seated condition against a tapered valve seat of the ring 85 under sufficient pressure to provide a seal and to seat the valve in the absence of a flow of material through the orifice. The valve is recessed from the end of the spout to provide a coherent stream of the contents. With the valve 220 of molded plastic, for example, polyethylene or polypropylene, the spring strips are inherently flexible and resilient. Valves of this construction are manufactured by Dab-O-Matic Corp., Mt. Vernon, New York. A snap on outer cap 88 is shown in phantom.

A further modification of the closure member 14 is shown at 314 in FIG. 9. The cap portion 324, threaded skirt 325 and intermediate member 316 are equivalent to the corresponding parts in the embodiment of FIG. 1. The spout portion 326 can be substantially shorter than the spout 26, but otherwise is of similar construction and includes a one-way discharge valve 320 and a deflector 321. A container, such as a plastic cup 90 is secured against the cap portion 324 through a circular opening 91 in a bottom wall 92. The circular opening 91 fits in fluid-tight relationship about the spout portion 326. The plastic cup 90 shown is a measuring cup bearing indicia 93 that indicate various volumes. Because the dispenser is always "full" until empty, it will always dispense contents when squeezed, even when held in an upright position. Accordingly, the cup 90 can be conveniently filled from the container 12 to any level desired while holding the dispenser upright and squeezing the container. The dispenser can then be tipped to pour the measured contents from the cup 90 while the contents within the dispenser is retained by the valve 320. With this construction, a very convenient measuring dispenser is provided.

A still further embodiment of the invention is shown in FIGS. 10 and 11 of the drawings, having a closure member 94 and an intermediate member 96 with a central post portion 98. The closure 94 has a threaded skirt 100 and a spout portion 102 that is at least in part flexible and resilient, and preferably of plastic. The spout portion terminates with a central orifice 104 that receives and closely surrounds the central post portion 98 when the spout is in its normal condition (equal pressure inside and outside the container). A resilient pleat, corrugation or diaphragm portion 106 extending circumferentially at the base of the spout portion yieldably holds the spout in a position with the orifice 104 surrounding the post, yet allows movement of the spout in a direction axially of the central post 98, so the spout cooperates with the post to form a one-way discharge valve that opens in response to a greater pressure inside the dispenser than outside and closes when the pressures are equal.

The intermediate member 96 includes an annular portion 108 of a size to rest against the edge of a container 12 about a threaded opening 111 where the closure member 94 is attached. When the closure is tightened, the annular portion 108 serves as a washer to provide a seal between the container 12 and closure, isolating the contents of the container from the threaded interconnection.

The central post portion 98 is essentially perpendicular to the plane of the annular portion 108 and is supported centrally of the annular portion by diametrically opposite spokes 113, 114 extending between the post and annular portion. As shown, the base of the post terminates in a plane of the spokes. The opposite or distal end of the post is formed with an external shoulder 116 and a projection terminal portion 118 of somewhat smaller diameter than the post, to form a seat and plug for the spout portion 102 at the central orifice 104. The post portion 98 has an internal passageway 119 along its length, with an internal shoulder 120 and an internal tapered valve seat 122. A one-way inlet valve 124 of similar construction to the valve 22 previously described is received within the passageway 119 with a supporting ring 126 located against the internal shoulder 120 and a tapered valve head 127 seated against the valve seat 122, urged into seated condition by spring strips 128. The extending end of a plastic tube 74' of a bladder 18' is received in the internal passage of the post, abutting against the ring 126.

In operation, when the container is squeezed, increased pressure within the container causes the contents to urge the flexible spout portion away from the seat formed by the shoulder 116 and reduced diameter portion 118 to permit the contents of be discharged. During squeezing of the container, the one-way inlet valve 124 remains against the seat 122, preventing the escape of displacement fluid from the bladder. Upon release of pressure against the container wall the flexible spout is returned by the resiliency of the pleat to a position against the seat of the center post, preventing entry of displacement fluid into the container through the discharge outlet. At the same time, the one-way inlet valve 124 is opened by the decrease in internal pressure within the bladder 18', and displacement fluid flows through passage 119 of the central post portion 98 of the intermediate member into the bladder to displace the contents dispensed.

Figure 12:
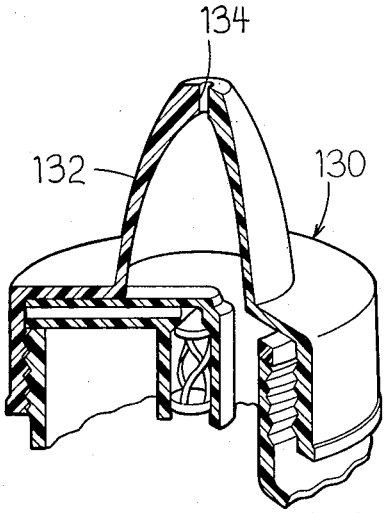
FIG. 12 is a partial sectional view of a further embodiment of a closure constructed to utilize the material being dispensed as a valve.

A modified closure member 130 is illustrated in FIG. 12 of the drawings, having a spout portion 132, but otherwise identical to the closure member 214 of FIG. 8. As shown, a discharge passage 134 is provided with a relatively small diameter for a substantial length. No mechanical valve is provided, but the construction in conjunction with a viscous contents in the dispenser serves a valving function to prevent inflow of displacement fluid after contents is dispensed. Viscous fluid, such as thick paste, within the relatively narrow and long discharge passage 134 has sufficient resistance to flow and flows sufficiently slowly that the inlet valve to the bladder opens and pressure is equalized through flow into the bladder before the passage 130 opens from backflow of the viscous fluid. The fluid, then, serves to plug the outlet for a time subsequent to dispensing sufficient to insure flow of displacement fluid only into the bladder.

In the various embodiments described, the closure members, intermediate members, bladders and containers are advantageously formed of suitable plastic, i.e., synthetic resin, material that provides the desired characteristics. The selection of particular resins appropriate for the purposes is well within the skill of the molder and does not form a part of the present invention. The closure member and intermediate member may advantageously be injection molded of, e.g., high density polyethylene for the intermediate member and low density polyethylene for the closure member.

From the foregoing it will be apparent that with the present invention a closure having only a dispensing opening and an opening for communication with a container, can be used to dispense flowable contents and to allow an in-flow of displacement fluid to be captured within an expansible bladder, without interfering with the dispensing. The intermediate member between the closure and container, with its connection to the bladder, facilitates this capture and locates the bladder in a desirable, effective, position for displacing dispensed contents without interfering with the path of the contents from the container to the discharge spout. The result is a squeeze type dispenser that is always "full" until empty and that has the outward appearance of a conventional container. The construction is economical to manufacture with conventional injection and blow molding techniques. The bladder construction is readily inserted into a filled container because of the internal tube extending substantially the length of the bladder, and retention of the intermediate member in proper position for application of the closure member facilitates high production filling and closing techniques.

While preferred embodiments have been disclosed in detail, it will be apparent that various modifications and alterations may be made therein without departing from the spirit and scope of the invention set forth in the appended claims.

What is claimed is:

1. In a dispensing apparatus for a flexible container, including:

a closure having first and second openings, said closure being threaded for attachment at the first opening to a threaded flexible container to cover an opening of the container, the second opening in the closure being a discharge passage through which contents of a container to which the closure is secured can be dispensed, said closure being constructed to allow flow through the second opening only in a direction from the container during use, an expansible bladder, a conduit within the closure to the bladder, providing an inlet opening to the bladder, and a check valve to allow flow through the conduit only into the bladder during use, the improvement comprising a member adapted to be located between the closure and container, said member forming at least a part of said conduit and having a locating portion secured in use between opposing portions of the closure and container, said conduit communicating through said member to the exterior of the closure through a passage along the threads between the closure and said container.

2. A dispensing apparatus as set forth in claim 1 wherein said member in part forms said check valve.

3. A dispensing apparatus as set forth in claim 2 wherein said member supports the bladder.

4. A dispensing apparatus as set forth in claim 3 wherein said locating portion is annular and said member includes a central post portion extending in a direction from the plane of said annular portion and having one end forming a plug for an apertured cover.

5. A dispensing apparatus as set forth in claim 4 wherein said conduit extends in part within said central post portion and opens through said locating portion.

6. A dispensing apparatus as set forth in claim 5 wherein said central post portion connects with and supports said bladder.

7. A dispensing apparatus as set forth in claim 1 wherein said check valve is in said conduit.

8. Improved structure for a squeeze-type dispenser that directly contains material to be dispensed and that has an internal expansible bladder for displacement fluid, a one-way discharge valve from the dispenser and a one-way inlet valve to the bladder; said improved structure comprising a rigid element having a support portion and a central post connected to the support portion, said central post having first and second portions, the first portion constructed to engage said bladder and the second portion comprising an end of the post, a passage from the post to the support portion opening at one end through the support portion and at the other end through the first portion of the post, said one-way inlet valve cooperating with said passage to limit flow therethrough to a direction from the said one passage end toward the other passage end, and a spout about said second portion of the post movable longitudinally thereof, said spout having a discharge opening adjacent the said end of the post and a surface about said discharge opening constructed to seat against the post, and means yieldably biasing said spout into seating engagement with the post, said post and spout forming said discharge valve.

9. The structure of claim 1 wherein the support portion is annular and planar, the post is perpendicular to the plane of the support portion and the support portion is secured in use between an open mouth of the container and a closure secured to the container, and wherein the spout is a part of the closure and at least a part of the closure is flexible to permit said longitudinal movement of the spout.

10. In a dispensing apparatus for a flexible container, including:

a closure having first and second openings, said closure being threaded at the first opening for securing it to a flexible threaded container to cover an opening of the container, the second opening in the closure being a discharge passage through which contents of a container to which the closure is secured can be dispensed, said closure being constructed to allow flow through the second opening only in a direction from the container during use, an expansible bladder, a conduit within the closure to the bladder, providing an inlet opening to the bladder, and a check valve to allow flow through the conduit only into the bladder during use, the improvement comprising a member adapted to be located intermediate the closure and the opening of a container to which the closure is secured in use, said member at least in part forming said conduit, and said conduit communicating to the exterior of the closure through a passage along the threads of the closure, the member having surfaces adapted to form a seal between the opening of said container and the closure to prevent flow of contents from the container to the exterior thereof through said passage along the threads of the closure, and said conduit opening into an area within the closure not sealed from the passage along the threads when the closure is secured to a container.

11. A dispensing apparatus as set forth in claim 10 wherein said member supports the bladder centrally of the closure and in part extends in a direction across said first opening.

12. A dispensing apparatus as set forth in claim 11 wherein said check valve is within said member.

13. A dispensing apparatus as set forth in claim 12 wherein the part of said conduit in the portion of said member extending in a direction across the first opening is straight and the check valve includes a movable sealing part extending into said straight portion of the conduit.

14. A member for forming a one-way inlet conduit for a dispenser, comprising a unitary annular support portion constructed to form a seal ring between a closure and a container about an opening of the container, said annular support portion being relatively narrow in the radial direction to provide a large central passageway through the member, and including a circular locating flange inset peripherally, a conduit portion defining an internal passageway within the member and extending from said annular portion inward beyond the annular portion, with an opening at the outer periphery of the annular support portion and at an inner end of the conduit portion located centrally of the annular support portion, and a one-way valve in the conduit portion inwardly of the annular support portion limiting flow through the passageway to a direction inwardly from the opening of the support portion.

15. A member as set forth in claim 14 wherein the annular portion has two parallel flat annular surfaces constructed to seal against opposing surfaces of a container and closure.

16. In a dispensing apparatus for a flexible container, including:

a closure having first and second openings, said closure being threaded at the first opening for receiving and securing it to a flexible threaded container to cover an opening of the container, the second opening in the closure being a discharge passage through which contents of a container to which the closure is secured can be dispensed, said closure being constructed to allow flow through the second opening only in a direction from the container during use, an expansible bladder, a conduit within the closure to the bladder, providing an inlet opening to the bladder, and a check valve to allow flow through the conduit only into the bladder during use, the improvement wherein the conduit to the bladder communicates through the first opening of the closure to the exterior of both the closure and a container to which the closure is secured, through a passage along threads of the closure at the first opening.

17. A dispensing apparatus as set forth in claim 16 wherein said conduit is at least in part defined by a member within but separate from said closure.

* * * * *

UNITED STATES PATENT AND TRADEMARK OFFICE

CERTIFICATE OF CORRECTION

PATENT NO. : 4,239,132

DATED : December 16, 1980

INVENTOR(S) : John J. Mueller and Glenn L. Beall

It is certified that error appears in the above-identified patent and that said Letters Patent are hereby corrected as shown below:

Column 6, line 6, "80" should be -- 60 --.

Column 11, line 22 (Claim 9, line 1), "1" should be -- 8 --.

Signed and Sealed this

*Thirty-first* Day of *March 1981*

[SEAL]

*Attest:*

RENE D. TEGTMEYER

*Attesting Officer*

*Acting Commissioner of Patents and Trademarks*